US006213575B1

(12) United States Patent
Brin, Jr. et al.

(10) Patent No.: US 6,213,575 B1
(45) Date of Patent: Apr. 10, 2001

(54) KITCHEN COUNTERTOP ASSEMBLY WITH MULTIPLE, VERTICALLY ADJUSTABLE INTEGRATED WORK SPACES

(75) Inventors: George G. Brin, Jr., Providence; Luke W. Michas, North Providence; Marc S. Harrison, deceased, late of Portmouth, by Diana Harrison, executrix; Michael T. Lye, Warwick; Edgar L. Laguinia, Providence, all of RI (US); Elizabeth Akers, Chicago, IL (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/440,126

(22) Filed: Nov. 15, 1999

(51) Int. Cl.[7] ..... A47B 96/18

(52) U.S. Cl. ..... 312/140.1; 312/209; 312/312; 312/319.8; 108/147

(58) Field of Search ..... 312/140.1, 140.2, 312/140.3, 246, 247, 319.5, 319.7, 319.8, 298, 312, 202, 196, 236, 228, 228.1, 229; 4/645; 108/147, 96

(56) References Cited

U.S. PATENT DOCUMENTS

| | | | | |
|---|---|---|---|---|
| 2,141,742 | | 12/1938 | Ehret . | |
| 2,456,429 | | 12/1948 | Parsons | 312/319.8 X |
| 2,861,857 | * | 11/1958 | Lee et al. | 312/312 |
| 3,215,483 | * | 11/1965 | Nelson | 312/312 X |
| 3,472,219 | | 10/1969 | Roy et al. . | |
| 3,502,384 | | 3/1970 | Gipson . | |
| 3,694,046 | | 9/1972 | Gehrmann | 312/196 |
| 4,009,918 | | 3/1977 | MacDonald et al. | 312/257.1 X |
| 4,544,214 | | 10/1985 | Nizel et al. | 312/209 |
| 5,088,420 | * | 2/1992 | Russell | 108/96 X |
| 5,129,611 | | 7/1992 | Grover et al. | 312/312 X |
| 5,161,868 | | 11/1992 | Hooser | 312/223.4 |
| 5,271,320 | * | 12/1993 | Reneau | 108/147 |
| 5,322,025 | * | 6/1994 | Sherman et al. | 108/147 |
| 5,867,847 | | 2/1999 | Klawitter et al. | 312/247 X |
| 5,909,933 | | 6/1999 | Keene et al. | 312/140.1 |

FOREIGN PATENT DOCUMENTS

| | | | | |
|---|---|---|---|---|
| 821924 | * | 9/1969 | (CA) | 108/96 |

* cited by examiner

*Primary Examiner*—James O. Hansen
(74) *Attorney, Agent, or Firm*—Everett G. Diederiks, Jr.

(57) ABSTRACT

A kitchen countertop assembly includes multiple, integrated work spaces having associated surfaces which can be adjusted vertically. At least two of the work surfaces can be individually, vertically adjusted relative to the remainder of the work surfaces. In accordance with the most preferred form of the invention, first, second and third work surfaces are defined by an overall kitchen island, with the first work surface being defined by a main countertop, the second work surface being defined by a tabletop supported above a portion of the first work surface by a pair of spaced pillars which project through the countertop and into a base of the assembly, and a third work surface is constituted by a table which projects from the base at a position offset from the countertop. With this arrangement, each of the countertop, tabletop and table member can be raised or lowered, either simultaneously or individually, in order to customize the overall kitchen countertop assembly to a particular user.

22 Claims, 3 Drawing Sheets

KITCHEN COUNTERTOP ASSEMBLY WITH MULTIPLE, VERTICALLY ADJUSTABLE INTEGRATED WORK SPACES

BACKGROUND OF THE INVENTION

1. Field of the Invention

The present invention concerns the environment of a kitchen and, more particularly, to a kitchen countertop assembly including multiple planar work surfaces which can be vertically adjusted simultaneously or individually.

2. Discussion of the Prior Art

Although countertop assemblies often found in modern day kitchens provide various vertically offset planar work surfaces, the surfaces are almost invariably fixed at respective, predetermined heights. More specifically, a typical kitchen will include a main countertop work surface and, perhaps, an upper tabletop which is spaced above the main work surface. In the case of a kitchen island, only the main countertop surface is typically provided. In any event, such countertop assemblies are generally fixed at a fairly standard height that is often established by the height of a cabinet base upon which the countertop is supported. Although this countertop height will be fairly standard throughout most residential homes in this country, the height of individuals utilizing the countertops can vary greatly. Therefore, a standard countertop height may not be convenient for shorter individuals, including those in wheelchairs and the like, or rather tall individuals.

Based on the above, there exists a need in the art for a kitchen countertop assembly which can be vertically adjusted to accommodate a wide range of users. More specifically, there exists a need in the art for a versatile countertop assembly incorporating various integrated work surfaces can be vertically adjusted simultaneously or individually in a convenient manner such that the heights of the various work surfaces can be customized to the preference of the user.

SUMMARY OF THE INVENTION

The present invention is directed to a kitchen countertop assembly including multiple, integrated work surfaces which can be vertically adjusted simultaneously or individually in order that the overall countertop assembly can be customized in a convenient manner to suit the particular needs of a user. More specifically, the countertop assembly includes a countertop including a main work surface that is supported above a base in a substantially horizontal plane. Preferably, the main work surface has mounted therein at least one of a sink and a cooktop. Arranged above at least a portion of the main work surface is a tabletop. The tabletop is preferably supported above the main work surface by various vertical legs or pillars which extend through respective openings formed in the countertop. Mounted within the base of the assembly are multiple linear actuators. At least one of the actuators is utilized to selectively, vertically adjust the height of the main work surface and, simultaneously, the height of the tabletop. However, another linear actuator mechanism in the base acts on the support pillars of the tabletop in order to adjust the height of the tabletop relative to the main work surface.

The kitchen countertop assembly also preferably incorporates a table member that can define a small breakfast area or the like. Preferably, the table member projects from and is supported by the base of the overall assembly in a manner which enables the table member to also be vertically adjusted. More specifically, in accordance with the most preferred form of the invention, the table member is vertically repositioned in unison with movement of the main work surface, while also being vertically adjustable relative to the main work surface.

With this overall construction, the various surfaces associated with the kitchen countertop assembly can be conveniently repositioned by a user such that the same countertop assembly can be effectively utilized by a wide range of people having varying height requirements. Preferably, a single control will enable each of the integrated work surfaces to be simultaneously adjusted in height. However, if additional adjustments are desired, the tabletop and/or the table member can be adjusted relative to the main work surface. The integrated work surface arrangement can be advantageously incorporated in an island of a kitchen.

Additional objects, features and advantages of the invention will become more readily apparent from the following detailed description of a preferred embodiment thereof when taken in conjunction with the drawings wherein like reference numerals refer to the corresponding parts in the several views.

DETAILED DESCRIPTION OF THE PREFERRED EMBODIMENT

Figure 1:
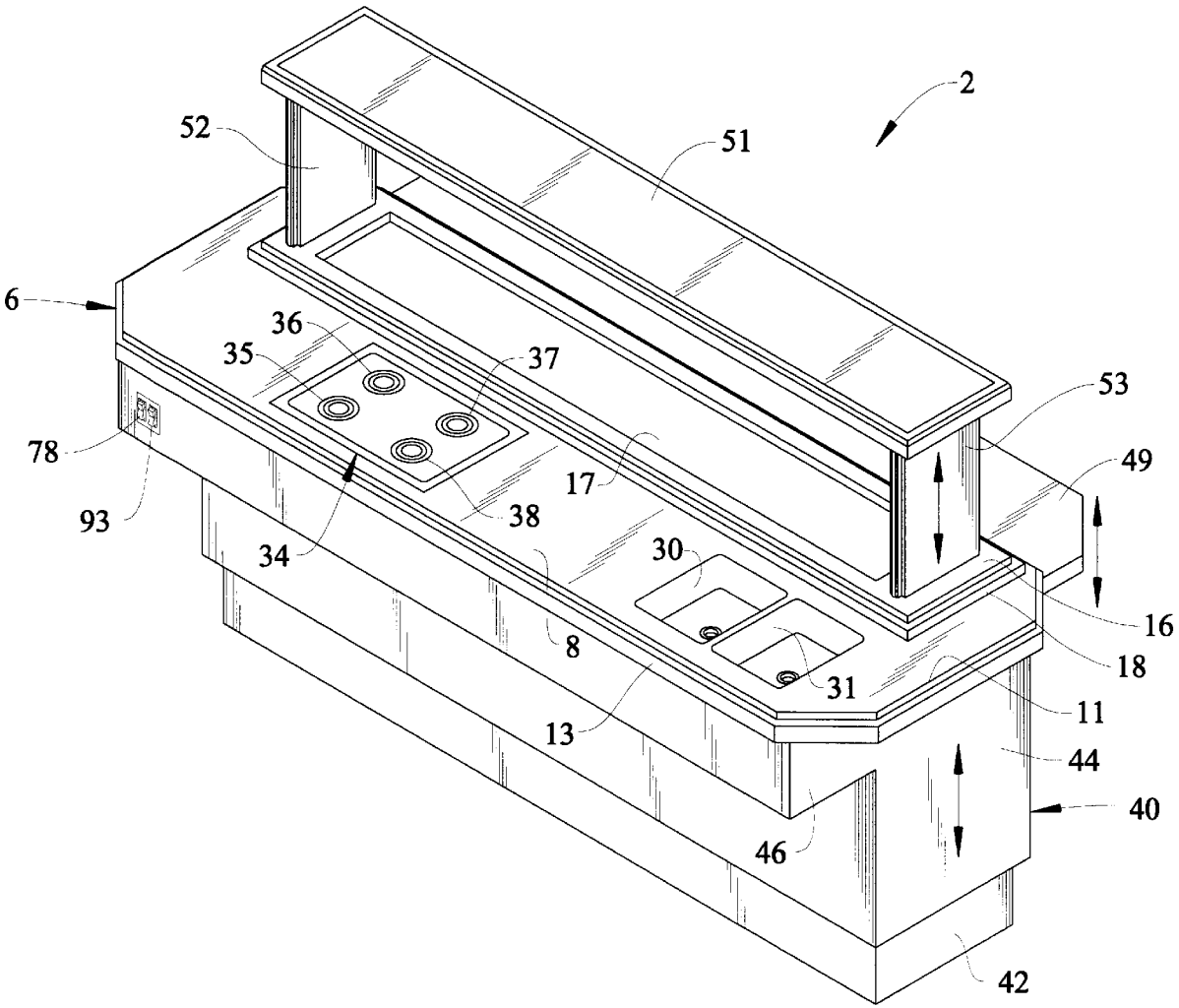
FIG. 1 is an upper respective view of a kitchen island incorporating multiple integrated and vertically adjustable work surfaces in accordance with the present invention.

With initial reference to FIG. 1, a workstation for a cooking environment that is generally illustrated to take the form of a kitchen island is indicated at 2. Island 2 includes an overall countertop 6 having a first or main work surface 8 that is preferably provided with a peripheral lip 11. Also located around first work surface 8, at a position slightly outwardly and below lip 11, is railing trim 13. As shown, countertop 6 also includes a raised platform 16 having a central zone 17 and an associated, intermediate tier 18. In the embodiment shown, island 2 is provided with a pair of spaced sinks 30 and 31, as well as a cooking appliance shown in the form of an electric cooktop 34. For the sake of simplicity of the drawings, a faucet for sinks 30 and 31, as well as controls for cooktop 34 have not been illustrated. However, cooktop 34 is shown to include multiple, spaced heating elements 35–38. Although the structure and arrangement of cooktop 34 is not considered part of the present invention, cooktop 34 preferably defines a substantially smooth working surface across countertop 6.

Countertop 6 is shown to be supported by a base 40 having a lowermost section 42 and an upper section 44 that includes an outwardly extending portion 46. Therefore, upper section 44, with outwardly extending portion 46, supports countertop 6 such that first work surface 8 extends in a substantially horizontal plane. At this point, it should be noted that outwardly extending portion 46 need not extend entirely across the longitudinal side of countertop 6 but could simply be constituted by various spaced, cantilevered beams if enhanced leg room or the like is desirable under countertop 6. In any event, upper section 44 of base 40 is further used to support a table 49 that is adapted to be used in connection with chairs or the like as a small breakfast or other eating area while the portion of countertop 6 located on the opposite side of platform 16 from table 49 would generally be located in the kitchen area. Again, this arrangement is merely presented in accordance with the preferred embodiment of the invention and for the sake of completeness. Island 2 is also shown to include an upper tabletop 51 that is spaced above platform 16 by means of pillars 52 and 53.

The present invention is particularly directed to the manner in which countertop 6, table member 49 and tabletop 51 can be selectively, vertically adjusted in unison or relative to each other such that the various work surfaces of island 2 can be placed at varying heights in order to customize the overall assembly to a particular user. More specifically, it is desired in accordance with the present invention to be able to shift countertop 6 vertically to adjust the height of main work surface 8. At the same time, table 49 and tabletop 51 will shift in unison with countertop 6. However, the present invention also provides for relative, vertical shifting between table 49 and work surface 8, as well as between tabletop 51 and work surface 8 of countertop 6. The preferred structure and arrangement to accomplish these functions in accordance with the present invention will now be particularly described with initial reference to FIG. 2.

Figure 2:
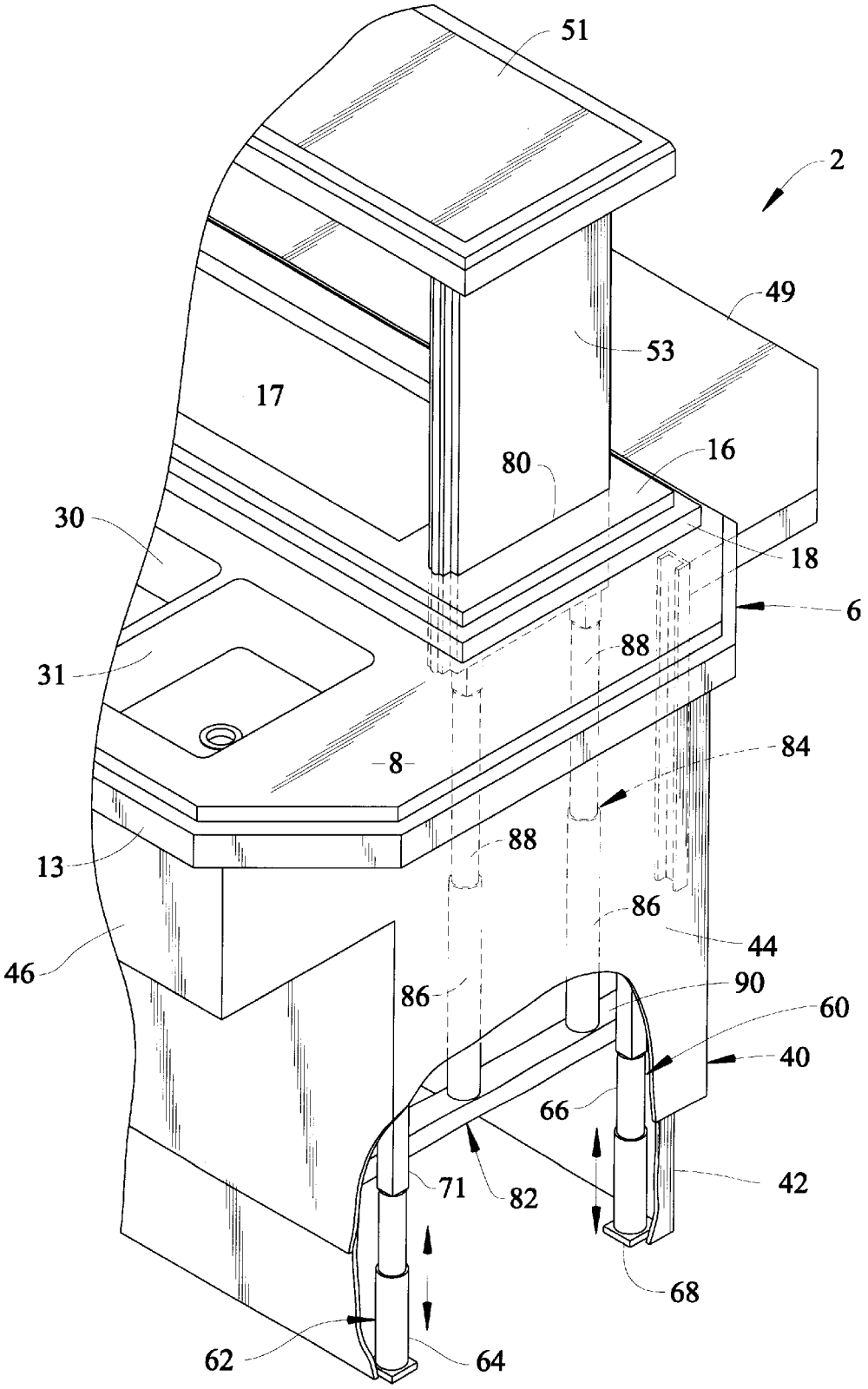
FIG. 2 is an enlarged, partial cut-away perspective view of an end portion of the island shown in FIG. 1.

As shown in this figure, island 2 incorporates a first adjusting mechanism 60 which is disposed within base 40. The first adjusting mechanism 60 is shown to including a pair of spaced linear actuators 62, each of which includes a cylinder 64 and a piston 66. Initially, it should be noted that, although two linear actuators 62 are illustrated, a single linear actuator could also be utilized. In addition, although FIG. 2 illustrates one end of island 2 generally adjacent sink 31, it should be recognized that a corresponding first adjusting mechanism 60 is provided on an opposing end of island 2. In any case, as shown, cylinder 64, at an end opposite piston 66, is secured to a plate 68. Plate 68 can either rest on a floor or supporting surface for countertop 6 or be fixedly secured to lowermost section 42 of base 40. In addition to be slidingly received within cylinder 64, each piston 66 is also attached to an internal frame member 71. Internal frame member 71 is secured to upper section 44 of base 40. In the most preferred form of the invention, each linear actuator 62 of first adjusting mechanism 60 utilizes hydraulic fluid to raise and lower pistons 66.

As shown in FIG. 1, island 2 is provided with a first toggle switch 78 which is used to control first adjusting mechanism 60 for both raising and lowering of each piston 66. Due to the interconnection of cylinder 64 to lowermost section 42 of base 40 and the connection of piston 66 to upper section 44 of base 40, the activation of first adjusting mechanism 60 will cause relative vertical shifting between lower and upper sections 42 and 44 and, correspondingly, an adjustment in the height of work surface 8. The particular range of adjustability accorded by first adjusting mechanism 60 can be readily established by the associated stroke of each linear actuator 62. However, to be reasonably effective so as to enable island 2 to be adjusted for a fairly wide range of user preferences, an adjustment range in the order of 4–10 inches, and most preferably 6–8 inches is provided. That is, upper section 44 of base 40 can be lowered about lowermost section 42 until upper section 44 almost reaches the support surface for island 2 or work surface 8 can be raised to the position generally illustrated in FIGS. 1 and 2.

In further accordance with the present invention, tabletop 51 can be separately adjusted in order to vary the distance between work surface 8 and tabletop 51. In the most preferred form of the invention, pillars 52 and 53 are vertically shiftable relative to countertop 6. More specifically, with reference to the right side mounting of tabletop 51, pillar 53 projects through an elongated opening 80 formed in platform 16, tier 18 and work surface 8 of countertop 6. Pillar 53 is supported by a second adjusting mechanism 82. More specifically, second adjusting mechanism 82 includes one or more linear actuators 84, each of which is defined by a cylinder 86 and a piston 88. Each cylinder 86 is shown to be fixed to a cross piece 90 that is secured within base 40. In the most preferred form of the invention, table 51 is shifted in unison with work surface 8 through first adjusting mechanism 60. To accomplish this function, cross piece 90 is directly, fixedly secured to either or both of upper section 44 of base 40 and internal frame member 71. In a manner similar to first adjusting mechanism 60, linear actuator 84 associated with second adjustment mechanism 82 preferably utilizes hydraulic fluid and the extension and retraction of pistons 88 within cylinders 86 can be controlled through a second toggle switch 93 which is shown adjacent first toggle switch 78 in FIG. 1. Again, although hydraulic actuators are utilized in accordance with the preferred embodiment, it should be readily apparent that other types of vertical adjustment mechanisms known in the art could be equally employed. For example, pneumatic, electric and the like type mechanisms could be utilized.

Figure 3:
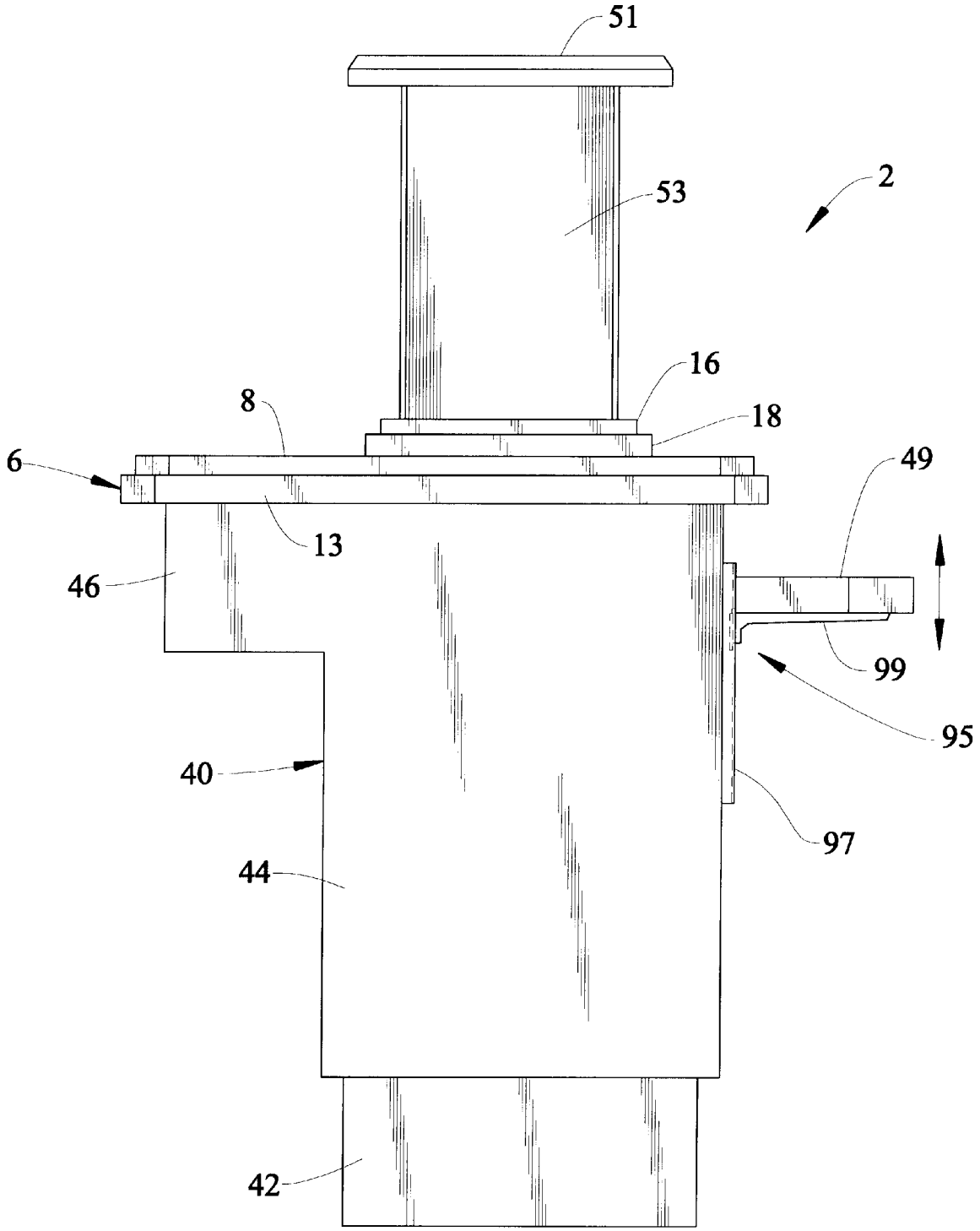
FIG. 3 is a side elevational view of the island of FIGS. 1 and 2.

In further accordance with the present invention, island 2 incorporates a third adjusting mechanism 95 for use in selectively, vertically adjusting table 49 relative to either of work surface 8 or tabletop 51. In the most preferred form of the invention as best shown in FIG. 3, the third adjusting mechanism 95 preferably includes a plurality of vertically extending rails 97 which are fixedly secured, at laterally spaced intervals, to upper section 44 of base 40, along with a corresponding number of cantilevered arms 99 upon which table 49 rests. In general, rails 97 and cantilevered arms 99 are of the type commonly found in the art for use in mounting refrigerator shelving or wall shelving. Therefore, although not particularly shown due to the view taken, each rail 97 includes a plurality of vertically spaced slots and each cantilevered arm 99 can be secured to a respective rail at a desired height by extending into a selected set of slots. Actually, third adjusting mechanism 95 can take various forms known in the art without departing from the invention. In fact, arms 99 could be fixedly secured through pistons of additional linear actuators mounted within base 40 and extend through slots formed in upper section 44 such that the vertical adjustment of table 49 could be controlled in a manner directly corresponding to that described above with respect to work surfaces 8 and tabletop 51. In addition, although rails 97 have been indicated to project along an outer surface of base 40, rails 97 could be equally embedded in the body of upper section 44 for aesthetic purposes.

With this construction, toggle switch 78 can be utilized to readily raise or lower each of the work surfaces associated with countertop 6, table 49 and tabletop 51. In addition, second toggle switch 93 can be utilized to vertically adjust tabletop 51 relative to each of work surface 8 and table 49. More specifically, tabletop 51 can be shifted from the raised position generally indicated in FIGS. 1–3 to a lowered position wherein tabletop 51 is set upon platform 16. Furthermore, table 49 can be vertically adjusted relative to both work surface 8 and table top 51 as desired. Therefore, the overall height of island 2, as well as the various planar work surfaces associated therewith, can be readily altered to accommodate various users that may range from a person in a wheelchair to a rather tall individual.

Although described with reference to a preferred embodiment of the invention, it should be readily understood that various changes and/or modifications can be made to the invention without departing from the spirit thereof. For instance, although tabletop 51 preferably adjusts in unison with the vertical shifting of work surface 8, relative shifting could be accomplished through the activation of first adjusting mechanism 60 by simply supporting second adjusting mechanism 82 either on the floor or through lowermost section of base 40. With such an arrangement, the raising or lowering of work surface 8 would not change the overall height of tabletop 51, but rather pillars 52 and 53 would simply slide through openings 80. A similar arrangement could be provided for table 49 if arms 99 project through elongated slots provided in upper section 44 and rails 47 were supported from lowermost section 42. In any event, in the most preferred embodiment of the invention, table 49 and tabletop 51 shift vertically in unison with work surface 8 of countertop 6 upon the activation of first adjusting mechanism 60. Regardless, the invention is only intended to be limited by the scope of the following claims.

We claim:

1. A kitchen countertop assembly comprising:

a countertop including a main work surface and a base for supporting the work surface in a substantially horizontal plane;

a tabletop supported above a portion of the work surface;

means for selectively, vertically adjusting both the countertop and the tabletop, said adjusting means enabling both concurrent and relative shifting of the countertop and tabletop, wherein the countertop can be raised or lowered in unison with the tabletop and a relative distance between the work surface and the tabletop can be separately altered; and at least one of a sink and a cooktop mounted in the work surface of the countertop.

2. The kitchen countertop assembly according to claim 1, further comprising: a table member projecting from the base for movement with the countertop through said adjusting means, said kitchen countertop assembly further including means for altering a height of the table member relative to the countertop.

3. The kitchen countertop assembly according to claim 2, wherein said countertop, tabletop, table member and adjusting means form parts of a kitchen island.

4. A countertop assembly comprising:

a countertop including a main work surface and a base for supporting the work surface in a substantially horizontal plane;

a tabletop supported above a portion of the work surface; and means for selectively, vertically adjusting both the countertop and the tabletop, said adjusting means enabling both concurrent and relative shifting of the countertop and tabletop, wherein the countertop can be raised or lowered in unison with the tabletop and a relative distance between the work surface and the tabletop can be separately altered, wherein said tabletop is supported above the work surface through a plurality of pillars, said adjusting means acting on the pillars to vertically shift the tabletop relative to the countertop.

5. The countertop assembly according to claim 4, wherein the countertop includes a plurality of openings extending through the work surface, each of said pillars extending through a respective one of said openings and into the base.

6. The countertop assembly according to claim 5, wherein the adjusting means comprises multiple linear actuators mounted within the base, at least one of the linear actuators being operable to simultaneously, vertically shift both the countertop and the tabletop and another of the linear actuators being operable to vertically shift only the tabletop.

7. The countertop assembly according to claim 6, wherein each of the linear actuators constitutes a hydraulic actuator.

8. The countertop assembly according to claim 4, further comprising: a platform arranged on the work surface, said tabletop being positioned above the platform.

9. A kitchen countertop assembly comprising:

first, second and third relatively offset, planar work surfaces; and means for selectively, vertically adjusting each of said work surfaces, said adjusting means including a first mechanism for simultaneously shifting each of said work surfaces and a second mechanism for vertically adjusting the second work surface relative to each of the first and third work surfaces.

10. The kitchen countertop assembly according to claim 9, further comprising: at least one of a cooktop and a sink mounted in the first work surface.

11. The kitchen countertop assembly according to claim 9, wherein the first, second and third work surfaces form parts of an overall kitchen island.

12. The kitchen countertop assembly according to claim 9, further comprising: a base, each of said first and second work surfaces being positioned directly above said base and said third work surface projecting substantially perpendicular from the base.

13. The kitchen countertop assembly according to claim 12, further comprising: a platform arranged on the first work surface, said second work surface being positioned above the platform.

14. The kitchen countertop assembly according to claim 12, wherein said second work surface is supported above the first work surface through a plurality of pillars, said adjusting means acting on the pillars to vertically shift the second work surface relative to the first work surface.

15. The kitchen countertop assembly according to claim 14, wherein the first work surface includes a plurality of substantially vertical openings, each of said pillars extending through a respective one of said openings and into the base.

16. The kitchen countertop assembly according to claim 9, further comprising: a base supporting each of the first, second and third work surfaces, wherein the adjusting means comprises multiple linear actuators mounted within the base, at least one of the linear actuators being operable to vertically shift both the first and second work surfaces simultaneously and another of the linear actuators being operable to vertically shift the second work surface relative to the first work surface.

17. The kitchen countertop assembly according to claim 16, wherein each of the linear actuators constitute hydraulic actuators.

18. A countertop assembly comprising:

first, second and third relatively offset, planar work surfaces;

first means for vertically adjusting the first work surface;

second means for vertically adjusting the second work surface relative to the first and third work surfaces; and third means for vertically adjusting the third work surface relative to the first and second work surfaces, wherein said first adjusting means vertically adjusts the second and third work surfaces simultaneously with the first work surface.

19. The countertop assembly according to claim 18, further comprising: a base, each of said first and second work surfaces being positioned directly above said base and said third work surface projecting substantially perpendicular from the base.

20. The countertop assembly according to claim 18, further comprising: a platform arranged on the first work surface, said second work surface being positioned above the platform.

21. A kitchen countertop assembly comprising:

first, second and third relatively offset, planar work surfaces;

first means for vertically adjusting the first work surface;

second means for vertically adjusting the second work surface relative to the first and third work surfaces;

third means for vertically adjusting the third work surface relative to the first and second work surfaces; and at least one of a cooktop and a sink mounted in the first work surface.

22. The kitchen countertop assembly according to claim 21, wherein the first, second and third work surfaces form parts of an overall kitchen island.

* * * * *